US007607928B2

(12) United States Patent
Schriefer et al.

(10) Patent No.: US 7,607,928 B2
(45) Date of Patent: Oct. 27, 2009

(54) EXPANDING SPACE SAVING POWER STRIP

(76) Inventors: Tavis D. Schriefer, 1846 Rosemeade Pkwy. Ste 144, Carrolton, TX (US) 75007; Edward A. Stanfield, 1846 Rosemeade Pkwy. Ste 144, Plano, TX (US) 75007

( * ) Notice: Subject to any disclaimer, the term of this patent is extended or adjusted under 35 U.S.C. 154(b) by 0 days.

(21) Appl. No.: 11/619,700

(22) Filed: Jan. 4, 2007

(65) Prior Publication Data

US 2007/0178756 A1 Aug. 2, 2007

Related U.S. Application Data

(60) Provisional application No. 60/762,629, filed on Jan. 27, 2006.

(51) Int. Cl.
*H01R 4/60* (2006.01)

(52) U.S. Cl. ..... 439/214

(58) Field of Classification Search ..... 439/214, 439/640, 632

See application file for complete search history.

(56) References Cited

U.S. PATENT DOCUMENTS 4,867,701 A 9/1989 Wiand
5,582,522 A 12/1996 Johnson
5,584,724 A * 12/1996 Shibata et al. ..... 439/507
5,738,548 A 4/1998 Rutulante
D420,643 S 2/2000 Yu
6,042,426 A 3/2000 Byrne
6,045,399 A 4/2000 Yu
6,190,199 B1 2/2001 Bump et al.
6,454,584 B1 9/2002 Milan
6,486,407 B1 11/2002 Hawker et al.
6,663,435 B2 12/2003 Lincoln, III et al.
6,755,676 B2 6/2004 Milan
6,875,051 B2 4/2005 Pizak
7,004,786 B1 2/2006 Bloom et al.
7,172,428 B2 * 2/2007 Huang ..... 439/11
2001/0027066 A1 10/2001 Loh
2003/0103304 A1 6/2003 Rendic
2004/0218411 A1 11/2004 Luu et al.

* cited by examiner

*Primary Examiner*—Javaid Nasri
(74) *Attorney, Agent, or Firm*—QuickPatents, Inc.; Kevin Prince

(57) ABSTRACT

An electrical outlet strip is disclosed, the outlet strip comprised of a power source, such as a power cable, and a plurality of socket modules. At least one socket module includes at least one electrical socket electrically interconnected with the power source. Each socket module is mechanically and adjustably engaged with at least one other socket module, whereby the outlet strip is expandable and compressible such that both small power plugs and larger AC adapters may be plugged into the electrical socket of each socket module.

13 Claims, 4 Drawing Sheets

EXPANDING SPACE SAVING POWER STRIP

CROSS-REFERENCE TO RELATED APPLICATIONS

This application claims the benefit of U.S. Provisional Patent Application 60/762,629, filed on Jan. 27, 2006.

STATEMENT REGARDING FEDERALLY SPONSORED RESEARCH AND DEVELOPMENT

Not Applicable.

FIELD OF THE INVENTION

This invention relates to electrical outlet strips, and more particularly to an outlet strip that has expandable socket modules.

DISCUSSION OF RELATED ART

The popularity of electrical outlet strips has grown in step with the increased use of personal computer equipment, audio and video equipment, and the like. A typical conventional outlet strip has six to eight power sockets spaced a fixed distance apart, and typically also includes a power switch, a power indicator light, and often power surge protection and over-current circuit breaker protection. Often all of the power sockets on such an outlet strip are necessary, given the number of electrical components requiring power with a typical computer workstation, for instance.

With the increased use of electrical devices that use low-voltage AC adapters, many of which take a considerable amount of space due to their design, the power sockets of conventional outlet strips are often covered by at least a portion of the AC adapter, effectively reducing the number of devices that can be plugged into such a conventional outlet strip.

To overcome the drawbacks of such convention outlet strips, modular outlet strips have been devised that can be expanded when additional power sockets are required. For example, U.S. Pat. No. 6,045,399 to Yu on Apr. 4, 2000; U.S. Pat. No. 5,582,522 to Johnson on Dec. 10, 1996; U.S. Pat. No. 6,755,676 to Milan on Jun. 29, 2004; U.S. Pat. No. 6,454,584 to Milan on Sep. 24, 2002; and US Patent Application 2001/0027066 to Loh on Oct. 4, 2001 all teach such modular outlet strip devices. With such devices, however, AC adapters can still cover adjacent electrical sockets, and thus a socket is rendered effectively useless. This is wasteful of both the money it takes to pay for such wasted sockets, as well as the additional space required to expand the outlet strip by a fixed module size. Further, each such additional power socket module may inadvertently become at least partially disconnected from the rest of the outlet strip, causing at best a loss of power in the additional sockets and, at worst, a potentially dangerous electrical condition.

Other prior art devices provide a variety of outlets at differing but fixed distances apart. For example, U.S. Pat. No. 6,663,435 to Lincoln III et al. on Dec. 16, 2003; U.S. Pat. No. 7,004,786 to Bloom et al. on Feb. 28, 2006; U.S. Pat. No. 6,875,051 to Pizak on Apr. 5, 2005; U.S. Pat. No. 6,042,426 to Byrne on Mar. 28, 2000; U.S. Pat. No. 5,738,548 to Rutulante on Apr. 14, 1998; US D420,643 to Yu on Feb. 15, 2000; and U.S. Pat. No. 4,867,701 to Wiand on Sep. 19, 1989 are all exemplary of such prior art devices. While such devices do allow for a variety of oversized AC adapters and conventional plugs to be used therewith, the exact mix of AC Adapters to conventional plugs is fixed (as with the Wiand device), or all of the electrical sockets are sufficiently spaced to allow for AC adapters (as with, for example, the Rutulante device). As such, these types of prior art devices are either inflexible in their mix of AC Adapters to conventional plugs, or they take-up excessive space and are bulky. All of these types of devices are overly bulky and excessively large if, in fact, no AC adapters are being used with such devices.

Other prior art devices use what are essentially a plurality of short extension cords, each terminating at an electrical socket, plugged into a conventional outlet strip. For example, U.S. Pat. No. 6,190,199 to Bump et al. on Feb. 20, 2001; and U.S. Pat. No. 6,486,407 to Hawker et al. on Nov. 26, 2002 teach such devices. While a variable mix of AC adapters to conventional power plugs can be used with such devices, these prior art inventions are themselves relatively bulky and have a somewhat disorganized appearance. Further, such devices tend to be relatively expensive to manufacture, since a separate power cord with a terminating electrical socket is required for each outlet of the device, and such a power cord and electrical socket is relatively more expensive to manufacture than a single outlet in a conventional outlet strip. It is often the case that the user of such a device desires to keep the outlet strip in an essentially linear configuration, as opposed to a fanned-out configuration as with at least the Hawker device.

Therefore, there is a need for an outlet strip that has mutually adjustable spacing between each outlet to accommodate any given size of power plug or AC adapter. Such a needed device would be relatively inexpensive to manufacture, yet would be highly flexible in the types and mix of power plugs, AC adapters, and like items that could be used with such a device. Further, such a device would not allow outlet sockets to become detached from the base unit, increasing the safety of such a device. The needed device would be collapsible down to a conventional outlet strip size when oversized AC adapters are not being used, and would require no special tools to expand when an oversized device is added. The present invention accomplishes these objectives.

SUMMARY OF THE INVENTION

The present device is an electrical outlet strip of the invention comprised of a power source and a plurality of socket modules, at least one of which includes at least one electrical socket electrically interconnected with the power source. Each socket module is mechanically and adjustably engaged with at least one other socket module. Thus, the outlet strip is expandable and compressible such that both small power plugs and larger AC adapters may be plugged into the electrical socket of each socket module.

One of the socket modules is preferably a base module, the power cord being fixed and electrically connected thereto. The base module is adapted for mechanically and adjustably engaging at least one of the other socket modules, and for electrically interconnecting the power cord to the at least one socket module. An end socket module is included that is adapted for mechanically adjustable engagement to exactly one other adjacent socket module.

Each electrical socket of each socket module is electrically connected to the electrical socket of each adjacent socket module with a plurality of electrical conductors, such as flexible electrically-conductive and insulated wire, a rigid, conductive bus bar, or a combination of both, traversing through each socket module. Enough slack is included in each of the conductors such that adjacent socket modules may be mutually adjusted without putting strain on the electrical connections of the conductors and the electrical sockets.

In use, the outlet strip is plugged into a wall outlet and, typically, set into a collapsed position, wherein each socket module is nested with each immediately adjacent module. Power plugs are plugged into selected power sockets of the various modules, and in the case where an AC adapter is to be plugged in, a module is selected and each adjacent module is adjusted away from the selected module, thereby making room for the AC adapter to be plugged into the selected module.

The present invention is an outlet strip that has mutually adjustable spacing between each outlet to accommodate any given size of power plug or AC adapter. The present device is relatively inexpensive to manufacture, yet is highly flexible in the types and mix of power plugs, AC adapters, and like items that can be used therewith. Further, as each socket module is not detachable from the unit as a whole, prongs and other electrodes will not be inadvertently exposed, making the present device safer than some of the prior art devices with detachable outlet modules. Also, the current invention is collapsible into a conventional outlet strip size when oversized AC adapters are not being used, and requires no special tools to expand when an oversized device is added. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
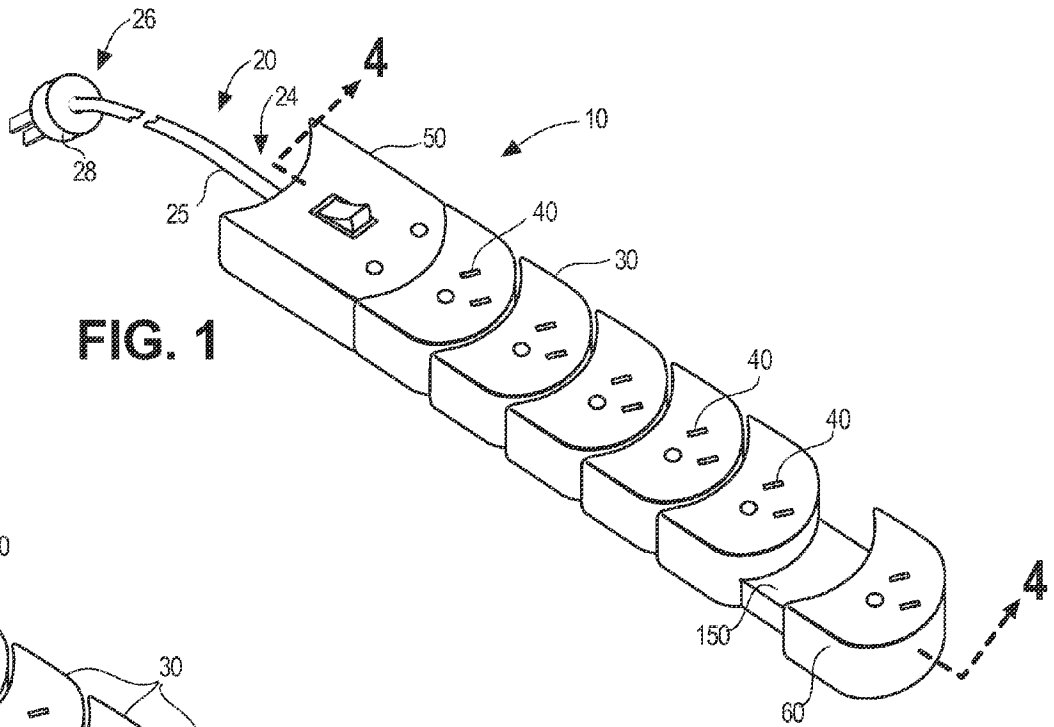
FIG. 1 is a perspective view of an electrical outlet strip of the invention, illustrating a plurality of socket modules.
Figure 4:
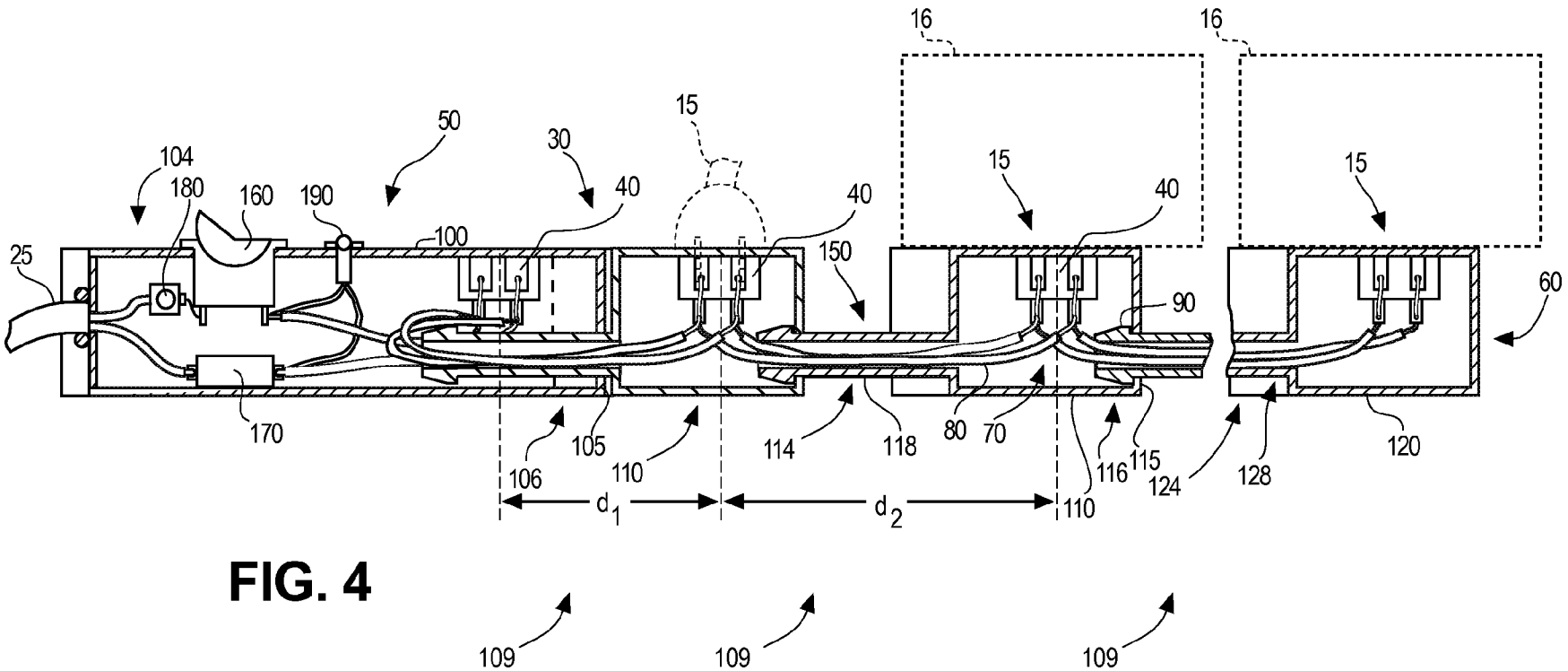
FIG. 4 is a cross-sectional view of the invention, taken generally along lines 4-4 of FIG. 1, illustrating internal wiring of the invention.

FIG. 1 illustrates an electrical outlet strip 10 of the invention. The outlet strip 10 is comprised of a power source 20 and a plurality of socket modules 30, at least one of which includes at least one electrical socket 40 electrically interconnected with the power source 20. Each socket module 30 is mechanically and adjustably engaged with at least one other socket module 30. The outlet strip 10 is expandable and compressible such that both small power plugs 15 and larger AC adapters 16 (FIG. 4) may be plugged into the electrical socket 40 of each socket module 30, each socket module 30 being adjustable such that for smaller power plugs 15 each socket module 30 may nest with each adjacent socket module 30, a distance d1 being provided between electrical sockets 40 (FIG. 4). With the larger AC adapters 16, a distance d2 may be set between adjacent socket modules 30, thereby providing not only sufficient space for each AC adapter 16 but cord control channels 150 between each socket module 30 (FIG. 4).

Preferably the power source 20 is a power cord 25 having a proximal end 24 and a distal end 26 (FIG. 1). The distal end 26 of the power cord 25 includes an electrical plug 28 for plugging into a conventional wall outlet (not shown), or the like. The proximal end of the power cord 25 is mechanically fixed to at least one of the socket modules 30.

One of the socket modules 30 is preferably a base module 50, the proximal end 24 of the power cord 25 being fixed and electrically connected thereto (FIG. 4). The base module 50 is adapted for mechanically and adjustably engaging at least one of the other socket modules 30, and for electrically interconnecting the power cord 25 to the at least one socket module 30. In the preferred embodiment of the invention, the base module 50 is adapted to connect to exactly one of the other socket modules 30; however, clearly the base module may be designed so as to connect to a plurality of the other socket modules, the base module 50 in such an embodiment forming the hub of a two, three, four, or five armed outlet strip 10 (not shown).

A mutual adjustment means 109 is include between each module 30,50,60 for mechanically adjusting the mutual distance between each neighboring modules 30,50,60. Preferably the mutual adjustment means 109 is a rigid neck 118 of one module 30,50,60 that is slidably fixed within an aperture 115 of the next adjacent module 30,50,60 (FIG. 4). However, other mutual adjustment means 109 may be used, such as, for example, apertures 115 in each module 30,50,60, surrounded by a mechanically adjustable semi-rigid accordion-like boot (not shown), such that not only the relative distance between modules 30,50,60 may be adjusted, but the relative angle between each module 30,50,60 may also be adjusted. Rigid sliding bars (not shown) may be slidably fixed between each module 30,50,60 to give the outlet strip 10 overall rigidity. Other mutual adjustment means 109 may be devised without departing from the spirit and scope of the present invention.

The base module 50 includes a housing 100 fixed at a distal end 104 thereof to the proximal end 24 of the power cord 25 (FIG. 4). The housing 100 includes an aperture 105 therein at a proximal end 106 thereof, the base module 50 being adapted for conducting power from the power cord 25 through the housing 100. Each socket module 30 further includes a substantially hollow housing 110 that includes the aperture 115 therein at a proximal end 116 thereof, and the neck portion 118 at a distal end 114 thereof. The neck portion 118 of each socket module 30 is adapted for slidable engagement with the aperture 115 of the next adjacent module 30, and each socket module 30 includes an electrical socket electrically interconnected to each next adjacent module 30. Each neck portion 118 includes a stop means 90 (FIG. 4), such as a ridge that is larger than the aperture 115 of each other socket module 30, so that once captured within the aperture 115 of an immediately adjacent socket module 30, the neck portion 118 is prevented from completely disengaging each adjacent module 30.

Figure 5:
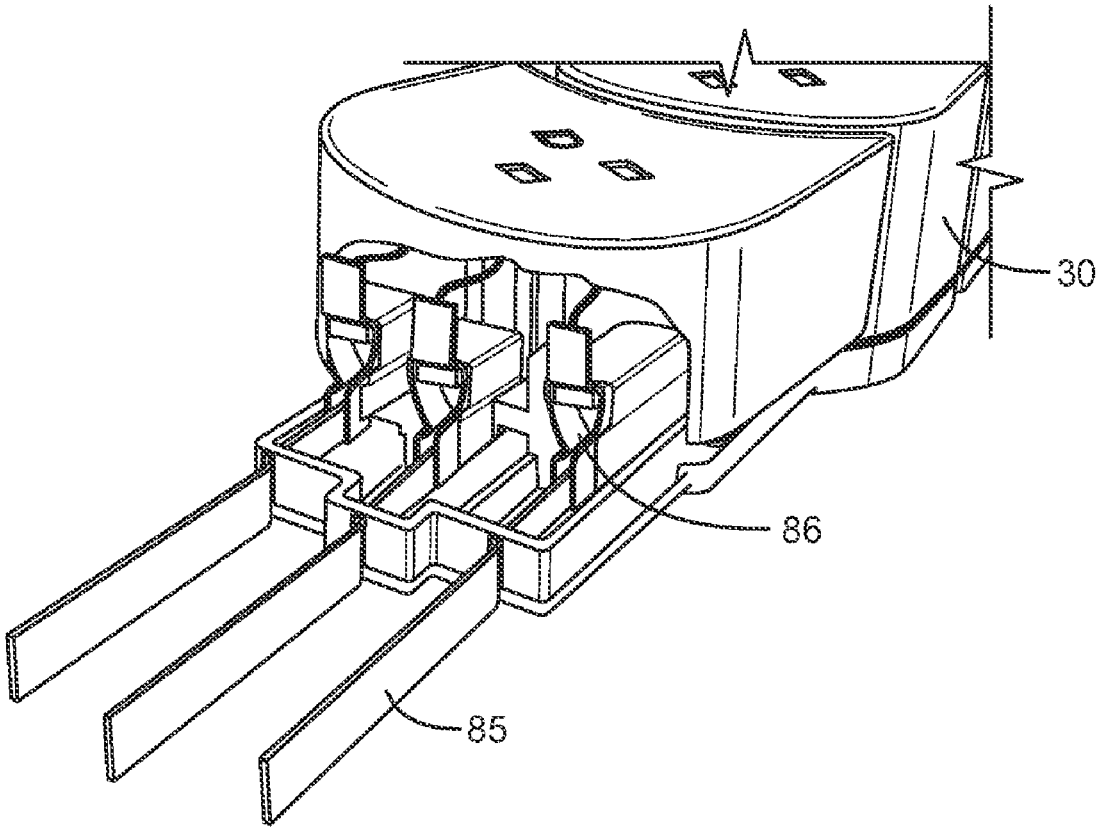
FIG. 5 is a perspective view, partially cut-away, of a socket module of the invention, illustrating an embodiment having rigid, conductive bus bars and sliding conductive contacts.
Figure 6:
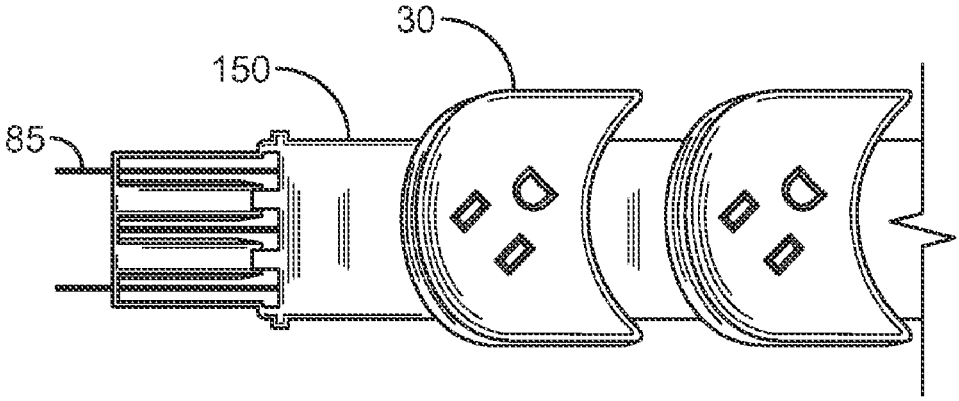
FIG. 6 is a top-plan view, partially cut-away, of a socket module of the invention, illustrating the embodiment having bus bars.

Each electrical socket 40 of each socket module 30 is electrically connected to the electrical socket 40 of each adjacent socket module 30 with a plurality of electrical conductors 70, such as, preferably, rigid conductive bus-bars 85 and sliding conductive contacts 86 (FIGS. 5 and 6), or, alternately, flexible electrically-conductive and insulated wire 80 (FIG. 4), traversing through each socket module 30. Enough slack is included in each of the conductors 70 such that adjacent socket modules 30 may be mutually adjusted without putting strain on the electrical connections of the conductors 70 and the electrical sockets 40. Such conductors 70 may be bent or twisted into loops to accommodate the required slack, for example. Each electrical socket 40 is thus connected in parallel to the power source 20 (FIG. 1).

Figure 2:
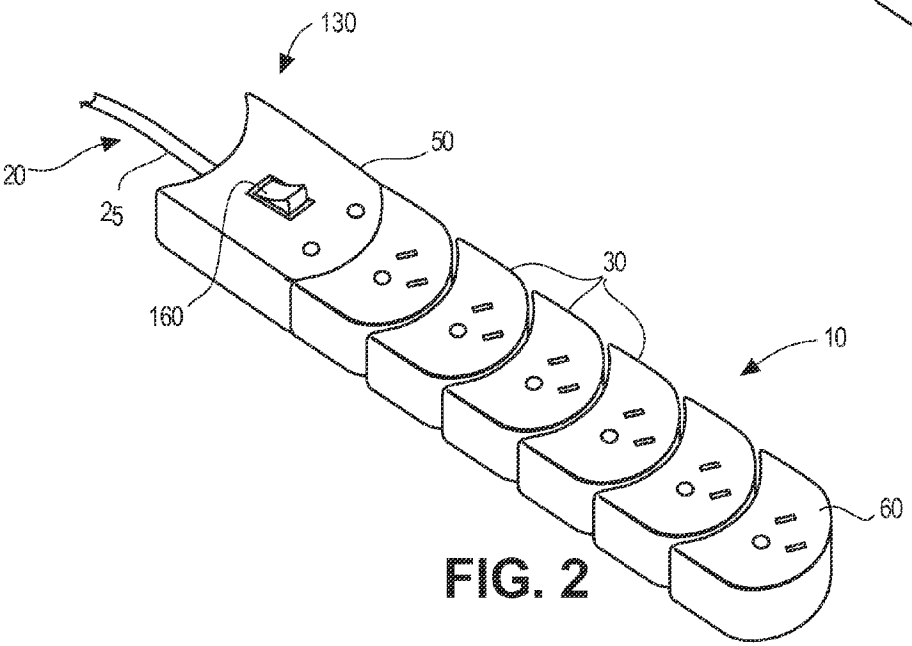
FIG. 2 is a perspective view of the electrical outlet strip of the invention, illustrating the plurality of socket modules in a collapsed position.
Figure 3:
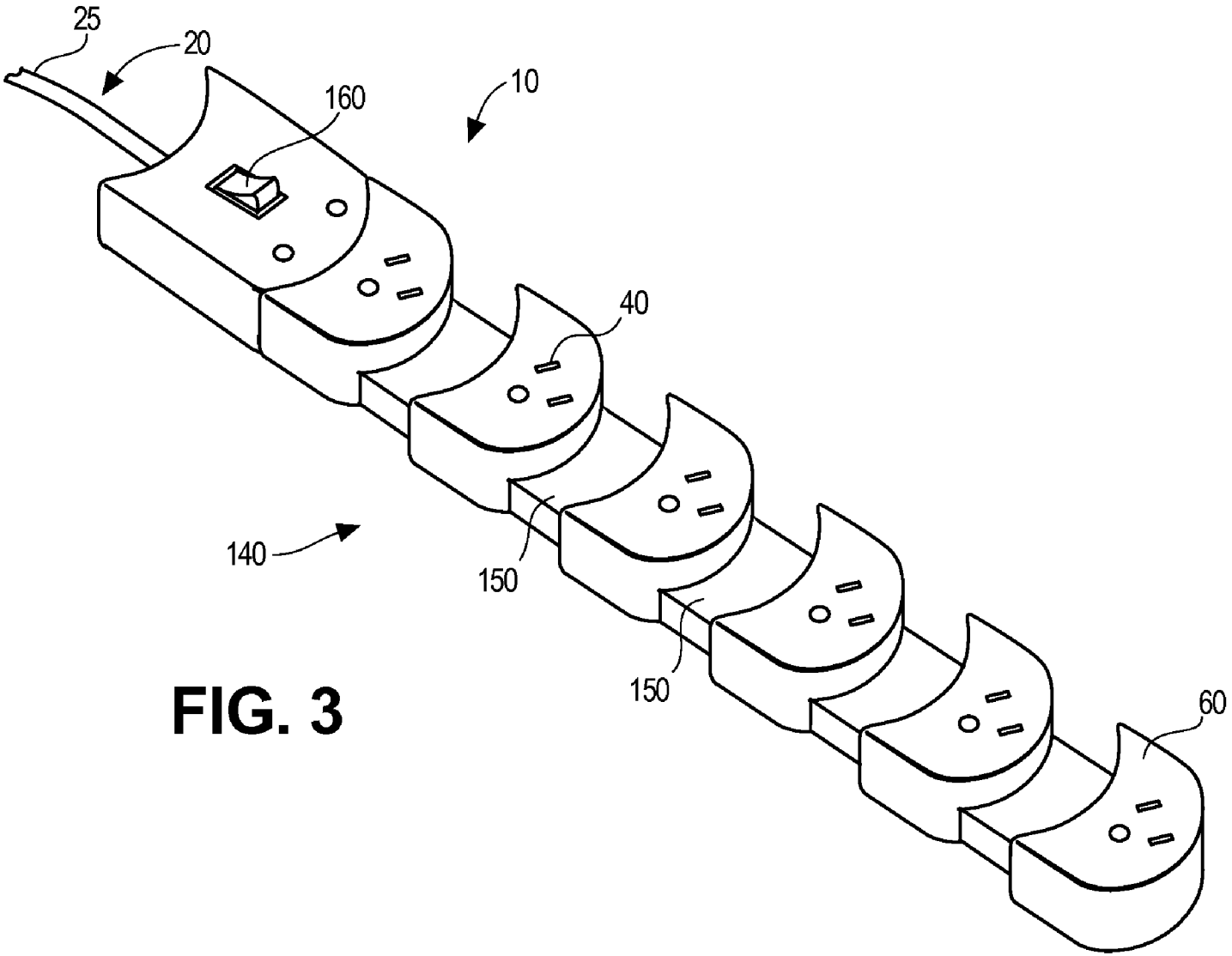
FIG. 3 is a perspective view of the electrical outlet strip of the invention, illustrating the plurality of socket modules in an expanded position.

In the preferred embodiment, an end socket module 60 is included that is adapted for mechanically adjustable engagement to exactly one other adjacent socket module 30 (FIGS. 1-3). In the preferred embodiment of the invention, having a linear strip of socket modules 30, only one end socket module 60 is required. However, in alternate embodiments wherein the base module 50 is a hub having two or more linear branches, one end socket module 60 is required at the end of each branch (not shown). The end module 60 includes a substantially hollow housing 120 having a neck portion 128 at a distal end 124 thereof. The neck portion 128 is adapted for slidable engagement with the aperture 115 of the next adjacent module 30, and includes an electrical socket 40 electrically interconnected to the next adjacent module 30. (FIG. 4)

In use, the outlet strip 10 is plugged into a wall outlet (not shown) or similar power source and, typically, set into a collapsed position 130 (FIG. 2), wherein each socket module 30 is nested with each immediately adjacent module 30,50, and with the neck portions 118,128 (FIG. 4) of each module 30,60 being inserted completely into each next adjacent module 30,50. Power plugs 15 are plugged into selected power sockets 40 (FIG. 1) of the various modules, and in the case where an AC adapter 16 is to be plugged in, a module 30 is selected and each adjacent module 30 is adjusted away from the selected module 30, thereby making room for the AC adapter 16 to be plugged into the selected module 30. Each power socket 40 may accept one of the AC adapters 16 when the outlet strip 10 is placed in an expanded position 140, as illustrated in FIG. 3, wherein each module 30 is pulled away from each other module 30. Further, each neck portion 118, 128 of either the selected module 30 or one of its adjacent modules 30 forms a cable management channel 150 (FIG. 1).

Preferably each module 30,50,60 is made from a rigid, non-conductive plastic material suitable for use in electric applications. Such plastic material is rigid enough to withstand a substantial amount of torque that can be exerted from one module 30,50,60 to the next. Each neck portion 118,128 is also suitably rigid and durable, and may include a metallic reinforcement therein (not shown) for added strength. Each module 30,50,60 may be molded in two or more sections (not shown), such that modules 30,50,60 may each be assembled successively, one captured within each adjacent module. Alternately, each stop means 90 may include an inclined surface, as illustrated, such that the neck portion 118,128 of each module 30,60 may be inserted into the aperture 105,115 of each adjacent module 50,30 in one direction, but then once captured thereby same cannot be removed.

The base module 50 may further include a power switch 160 for selectively supplying power to the sockets 40 (FIGS. 3 and 4). Further, a surge-protection circuit 170 may be electrically connected in parallel to each electrical socket 40 for protecting each electrical socket 40 from power surges. A circuit-breaker 180 may be connected in series with the power source 20 to provide over-current protection (FIG. 4). At least one electrical status light indicator 190 may be included for indicating the status of the power switch 160. Components for uninterrupted power functionality might also be included (not shown), such as batteries and associated electronics as is known in the art.

While a particular form of the invention has been illustrated and described, it will be apparent that various modifications can be made without departing from the spirit and scope of the invention. For example, the exact configuration of modules 50,30,60 may take various shapes, such as cross or star shapes (not shown, as opposed to a simple linear shape), each branch comprising socket modules 30 and an end module 60, and terminating at a common central hub 50. Further, the rotational orientation of each electrical socket 40 with respect to the axis of the neck portion 118,128 may be varied from the roughly 30° angle shown in the drawings. Still further, some of the socket modules 30 may include a cable TV socket, a phone socket, an Ethernet or computer interface socket (not shown), or the like, instead of an electrical socket 40. Indeed, some of the socket modules 30 may include no sockets of any type, but rather contain the electrical components such as the surge-protection circuit 170, or other components. Accordingly, it is not intended that the invention be limited, except as by the appended claims.

What is claimed is:

1. An electrical outlet strip comprising: a power cord having a proximal end and a distal end, the power cord adapted for receiving a power input at the distal end thereof and conducting it to the proximal end thereof; a base module including a housing fixed to the proximal end of the power cord at a distal end thereof, and including a mutual adjustment means, the base module adapted for conducting power from the power cord through the housing; a plurality of socket modules each including a substantially hollow housing, each socket module including the mutual adjustment means, and at least one socket module including at least one electrical socket electrically interconnected to each next adjacent module, each socket for receiving a power plug and providing power thereto; and an end module including a substantially hollow housing having the mutual adjustment means; whereby each socket module or end module may be pulled away from a collapsed position to its next adjacent module to manually select the distance between adjacent electrical sockets by manually adjusting the contiguous mutual adjustment means while maintaining electrical and mechanical connectivity.

2. The electrical outlet strip of claim 1 wherein each mutual adjustment means is a rigid neck of one socket module slidably retained within an aperture of an adjacent socket module.

3. The electrical outlet strip of claim 2 wherein each socket module is mechanically prevented from completely disengaging from each adjacent module with a stop means.

4. The electrical outlet strip of claim 2 wherein the neck portion of each socket module, when in an expanded position with relation to an adjacent module, forms a cable management channel therebetween.

5. The electrical outlet strip of claim 1 further including a conventional power plug fixed at the distal end of the power cord and electrically connected thereto.

6. The electrical outlet strip of claim 1 wherein each socket module is electrically connected to each adjacent socket module with a plurality of electrical conductors therein.

7. The electrical outlet strip of claim 6 wherein at least one of the plurality of electrical conductors is a rigid, conductive bus bar traversing through each socket module.

8. The electrical outlet strip of claim 6 wherein at least one of the plurality of electrical conductors is a flexible wire.

9. The electrical outlet strip of claim 1 wherein each socket module is mechanically nestable with each adjacent module when each adjacent module is in a collapsed position therewith.

10. The electrical outlet strip of claim 1 wherein the base module further includes a power switch for selectively supplying power to the sockets.

11. The electrical outlet strip of claim 10 further including at least one status light indicator on the base module for indicating the status of the power switch.

12. The electrical outlet strip of claim 1 further including a surge-protection circuit electrically connected in parallel to each electrical socket.

13. The electrical outlet strip of claim 1 further including a circuit-breaker electrically connected in series with the power source.

* * * * *